US010829352B2

(12) United States Patent
Lacher

(10) Patent No.: US 10,829,352 B2
(45) Date of Patent: Nov. 10, 2020

(54) MODULAR BACKSCREEN FOR IMPLEMENT

(71) Applicant: Clark Equipment Company, West Fargo, ND (US)

(72) Inventor: Robert R. Lacher, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 230 days.

(21) Appl. No.: 15/667,121

(22) Filed: Aug. 2, 2017

(65) Prior Publication Data

US 2018/0037448 A1 Feb. 8, 2018

Related U.S. Application Data

(60) Provisional application No. 62/370,457, filed on Aug. 3, 2016.

(51) Int. Cl.

| | |
|---|---|
| ***B66F 9/12*** | (2006.01) |
| ***E02F 9/00*** | (2006.01) |
| ***E02F 3/96*** | (2006.01) |
| *B66F 9/14* | (2006.01) |

(52) U.S. Cl.

CPC ..... *B66F 9/12* (2013.01); *B66F 9/122* (2013.01); *E02F 3/962* (2013.01); *E02F 9/00* (2013.01); *B66F 9/142* (2013.01)

(58) Field of Classification Search

CPC ..... E02F 3/8152; E02F 3/962; B66F 9/12; B66F 9/122; B66F 9/127

See application file for complete search history.

(56) References Cited

U.S. PATENT DOCUMENTS

| | | | |
|---|---|---|---|
| 2,814,402 | A | 1/1957 | Schaefer |
| 3,780,896 | A | 12/1973 | Crawford |
| 3,851,779 | A | 12/1974 | Crawford |
| 4,043,472 | A | 8/1977 | Hoyt |

(Continued)

FOREIGN PATENT DOCUMENTS

| | | | |
|---|---|---|---|
| CN | 102016183 | A | 4/2011 |
| CN | 103328371 | A | 9/2013 |

(Continued)

OTHER PUBLICATIONS

Invitation to Pay Fees and Written Opinion of the International Searching Authority dated Nov. 6, 2017 for International Application No. PCT/US2017/045095 filed Aug. 2, 2017, 13 pages.

(Continued)

*Primary Examiner* — Minh Truong

(74) *Attorney, Agent, or Firm* — John Veldhuis-Kroeze; Westman, Champlin & Koehler, P.A.

(57) ABSTRACT

Disclosed embodiments include backscreens, backscreen accessories for implements of power machines, and implements including the same. In the backscreens or backscreen accessories, a first backscreen portion is attached to a frame of the implement, for example by welding. The first backscreen portion includes at least one first portion interface feature. A second backscreen portion has at least one second portion interface feature. The at least one first portion interface feature and the at least one second portion interface feature are configured to engage one another to removably couple the second backscreen portion to the first backscreen portion.

19 Claims, 8 Drawing Sheets

(56) References Cited

U.S. PATENT DOCUMENTS

| | | | | |
|---|---|---|---|---|
| 4,178,034 | A * | 12/1979 | Mittendorf | B60K 11/04 180/68.6 |
| 4,239,446 | A | 12/1980 | Vucinic | |
| 4,407,080 | A * | 10/1983 | Mann | E02F 3/7609 37/405 |
| 4,526,504 | A | 7/1985 | Hovey | |
| 4,991,662 | A | 2/1991 | Caron et al. | |
| 5,220,980 | A | 6/1993 | Petter | |
| 5,279,405 | A | 1/1994 | Petter | |
| 5,392,864 | A * | 2/1995 | Lindenmuth | E02F 3/7618 172/701.1 |
| 5,478,196 | A | 12/1995 | Avitan et al. | |
| 6,146,081 | A | 11/2000 | Anderson | |
| 6,881,023 | B1 | 4/2005 | Sullivan | |
| 7,066,275 | B1 * | 6/2006 | Keigley | A01B 43/00 171/111 |
| 7,246,685 | B2 | 7/2007 | Tyree | |
| 7,730,599 | B2 | 6/2010 | Tyree | |
| 7,762,014 | B2 | 7/2010 | Brock et al. | |
| 7,909,562 | B2 | 3/2011 | Mead | |
| 8,585,344 | B2 | 11/2013 | Sharp | |
| 8,651,797 | B2 | 2/2014 | Magoto | |
| 9,290,366 | B2 | 3/2016 | Jones, Jr. et al. | |
| 9,457,999 | B2 * | 10/2016 | Belotti | B66F 9/12 |
| 10,113,297 | B1 * | 10/2018 | Henning | E02F 9/24 |
| 2003/0197351 | A1 * | 10/2003 | Burger | B62B 3/0612 280/651 |
| 2005/0254930 | A1 * | 11/2005 | Weinstein | B66F 9/12 414/659 |
| 2006/0243465 | A1 * | 11/2006 | Kallevig | B66F 9/12 172/378 |
| 2009/0265963 | A1 | 10/2009 | Brock et al. | |
| 2012/0171004 | A1 * | 7/2012 | Jones, Jr. | B66F 9/22 414/664 |
| 2014/0318901 | A1 * | 10/2014 | Philipopoulos | B66F 9/12 187/222 |
| 2017/0349417 | A1 * | 12/2017 | Pisarik | B66F 9/075 |

FOREIGN PATENT DOCUMENTS

| | | | |
|---|---|---|---|
| CN | 203269489 | U | 11/2013 |
| CN | 204981037 | U | 1/2016 |
| WO | 2012/094211 | A1 | 7/2012 |

OTHER PUBLICATIONS

International Search Report and Written Opinion dated Jan. 12, 2018 for International Application No. PCT/US2017/045095 filed Aug. 2, 2017, 20 pages.

First Office Action, for Chinese Patent Application No. 201780045509.X, dated Apr. 28, 2020, 14 pages.

Communication pursuant to Article 94(3) EPC for European Patent Application No. 17 754 236.2, dated Mar. 30, 2020, 5 pages.

* cited by examiner

MODULAR BACKSCREEN FOR IMPLEMENT

CROSS-REFERENCE TO RELATED APPLICATION

This application claims the benefit of U.S. Provisional Application No. 62/370,457, which was filed on Aug. 3, 2016.

BACKGROUND

The present disclosure is related to backscreens for implements attachable to power machines. More particularly, the present disclosure is related to a modular backscreen attachable to an implement such as a forklift implement.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Some examples of work vehicle power machines include loaders, excavators, utility vehicles, tractors, and trenchers, to name a few.

Some power machines can be operably coupled to implements that are capable of cooperating with the power machine to perform various tasks such as lifting heavy materials. Often the lifting of loads can be improved by a backscreen on the implement. Some loaders have lift arms that are capable of having a wide variety of implements operably coupled to them, ranging from a simple bucket or blade to relatively complex implements such as planers and graders that have work devices capable of performing various tasks. An instance of a widely used implement is a forklift, which is useful for lifting heavy loads. Forklift implements typically have forward extending tines or pallet forks for grabbing and carrying loads that are often on pallets. Such loads can be of various heights, including above the height of the tines themselves. To provide additional support for such loads, backscreens are often provided to support taller loads.

While backscreens are known to be useful for stabilization and support of loads, on some power machines such as some compact loaders, where access to a cab or operator compartment is through the front of the machine, backscreens and similar devices can impede the operator's ability to enter and exit the cab. Further, while larger backscreens are desirable to accomplish some tasks, in other instances, a large backscreen can impede an operator's vision or otherwise interfere with power machine and implement operation.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter.

The present disclosure includes backstops, backrests, and backscreens for implements such as forklifts. For the sake of brevity, the aforesaid structures will be referred to as backscreens hereinafter. Backscreens which attach to implements, such as forklifts with adjustable tines and fixed position forklifts, can be fixedly attached (e.g., welded) or removably attached to a frame of an implement. The backscreens herein include modular portions that can be arranged on a frame of an implement to provide various configurations of a backscreen as may be advantageous for attachment to a given power machine or for a given application.

In some exemplary embodiments, a backscreen accessory for an implement of a power machine includes a first backscreen portion attached to a frame of the implement, for example by welding. The first backscreen portion includes at least one first portion interface feature, which can include for example slots or tabs. The backscreen accessory also includes a second backscreen portion having at least one second portion interface feature, which can include for example corresponding tabs or slots. The at least one first portion interface feature and the at least one second portion interface feature are configured to engage one another to removably couple the second backscreen portion to the first backscreen portion.

In some embodiments, the second backscreen portion is removably coupled to the first backscreen portion at a position adjacent a side of the first backscreen portion. When removably secured, heights of top surfaces of the second backscreen portion and the first backscreen portion, relative to the implement, can be substantially the same. In other embodiments, the second backscreen portion is removably coupled to the first backscreen portion at a position which is both adjacent to, and above, the first backscreen portion.

In some embodiments, the backscreen accessory further includes a third backscreen portion configured to be attached to the frame of the implement. The third backscreen portion can include at least one third portion interface feature, and a second portion interface feature and a third portion interface feature can be engaged to removably couple the second backscreen portion also to the third backscreen portion.

In some embodiments, the backscreen portions include a plurality of vertically oriented members. In some embodiments, the backscreen portions include screens.

In another exemplary embodiment, an implement includes an implement interface configured to removably mount the implement to a power machine interface; a tool having a frame secured to the implement interface; and a modular backscreen attached to one of the implement interface and the tool. The modular backscreen includes a first backscreen portion attached to the one of the implement interface and the tool, with the first backscreen portion including a first portion interface feature. The modular backscreen also includes a second backscreen portion having a second portion interface feature. T first portion interface feature and the second portion interface feature are configured to engage to removably couple the second backscreen portion to the first backscreen portion.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Figure 6:
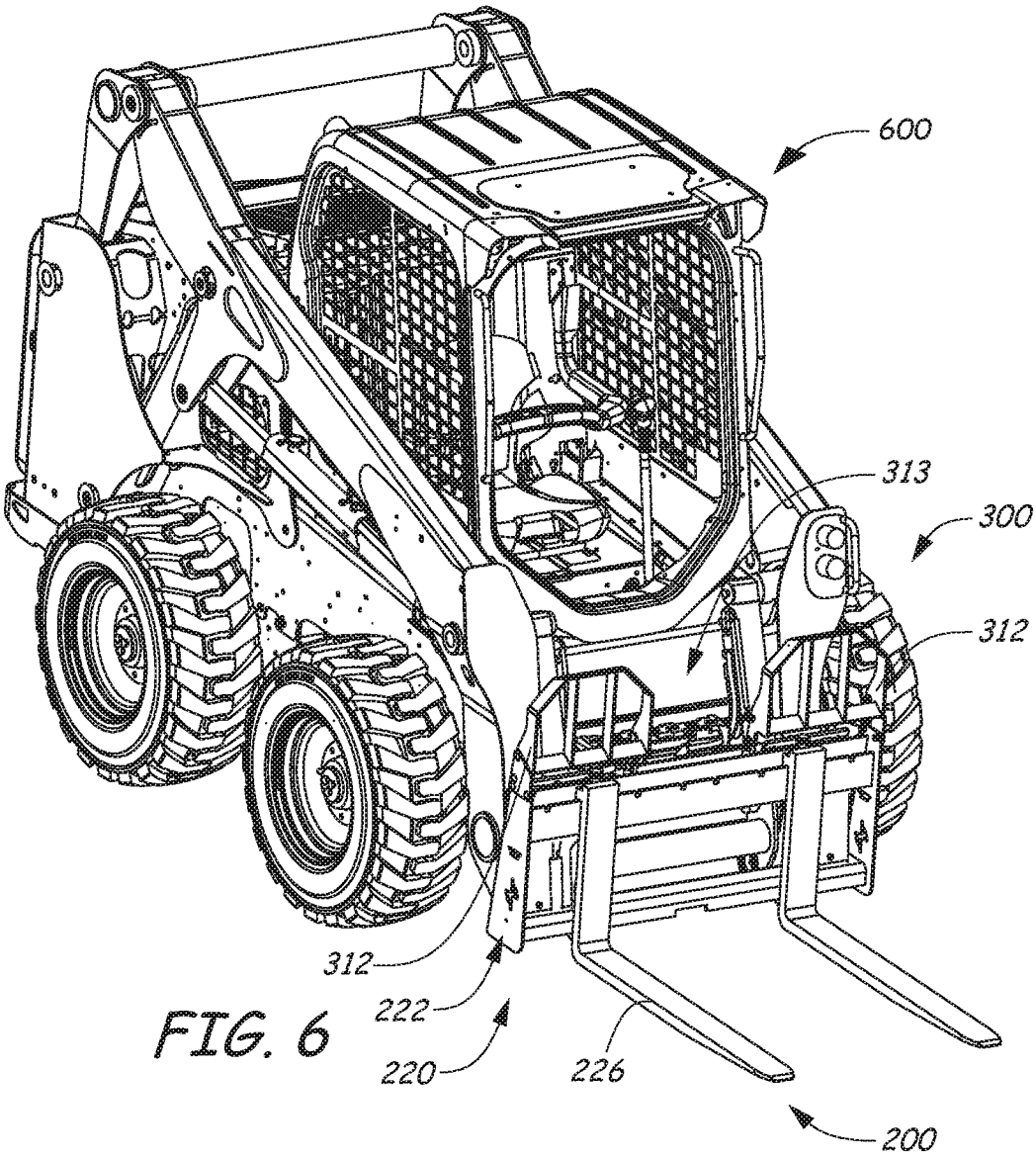
FIG. 6 illustrates a perspective view of the implement as configured in FIG. 5 operably coupled to one type of power machine on which a modular backscreen can be advantageously employed.

The present disclosure includes backstops, backrests, and backscreens (collectively "backscreens") for implements such as forklifts. The forklifts illustrated in the drawings are shown as exemplary fork lift implements, but the backscreens described herein can be attached to various types of forklifts and other implements besides the forklifts shown in the drawings and discussed below. The forklifts described herein can be attached to a power machine via an implement carrier of the power machine. Example parts of the backscreens can be fixedly attached (e.g., welded) or removably attached to a frame of an implement. The backscreens herein include modular portions, such as the guards described herein, that can be arranged on a frame of an implement in various ways. For example, one of the modular parts can be a center guard, such that when attached alone to an implement frame an operator can enter a front entry loader to either the right or left side of the center guard. Also, for instance, the modular parts can include multiple guards that can be spaced apart on an implement frame such that an operator can enter a front entry loader through the space between the guards. For example, space 313 between guards 312, illustrated in FIG. 6, provides an access way to an entry of an operator compartment or cab of a power machine. In another example, the modular parts can include one or more guards that can be inserted onto or between the spaced apart guards.

Disclosed embodiments include features which can be adapted or configured to provide one or more backscreens on an implement such as a forklift. The concepts can be practiced on various implements and various power machines, as will be described below. Representative implements 100, 100', 100" on which the embodiments can be practiced and representative power machines 10 and 10' to which the implement can be operably coupled are illustrated in diagram form in FIGS. 1-3 and described below before any embodiments are disclosed. For the sake of brevity, only one implement and power machine combination is discussed in detail. However, as mentioned above, the embodiments below can be practiced on any of a number of implements and these various implements can be operably coupled to a variety of different power machines. Power machines, for the purposes of this discussion, include a frame, in some instances at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
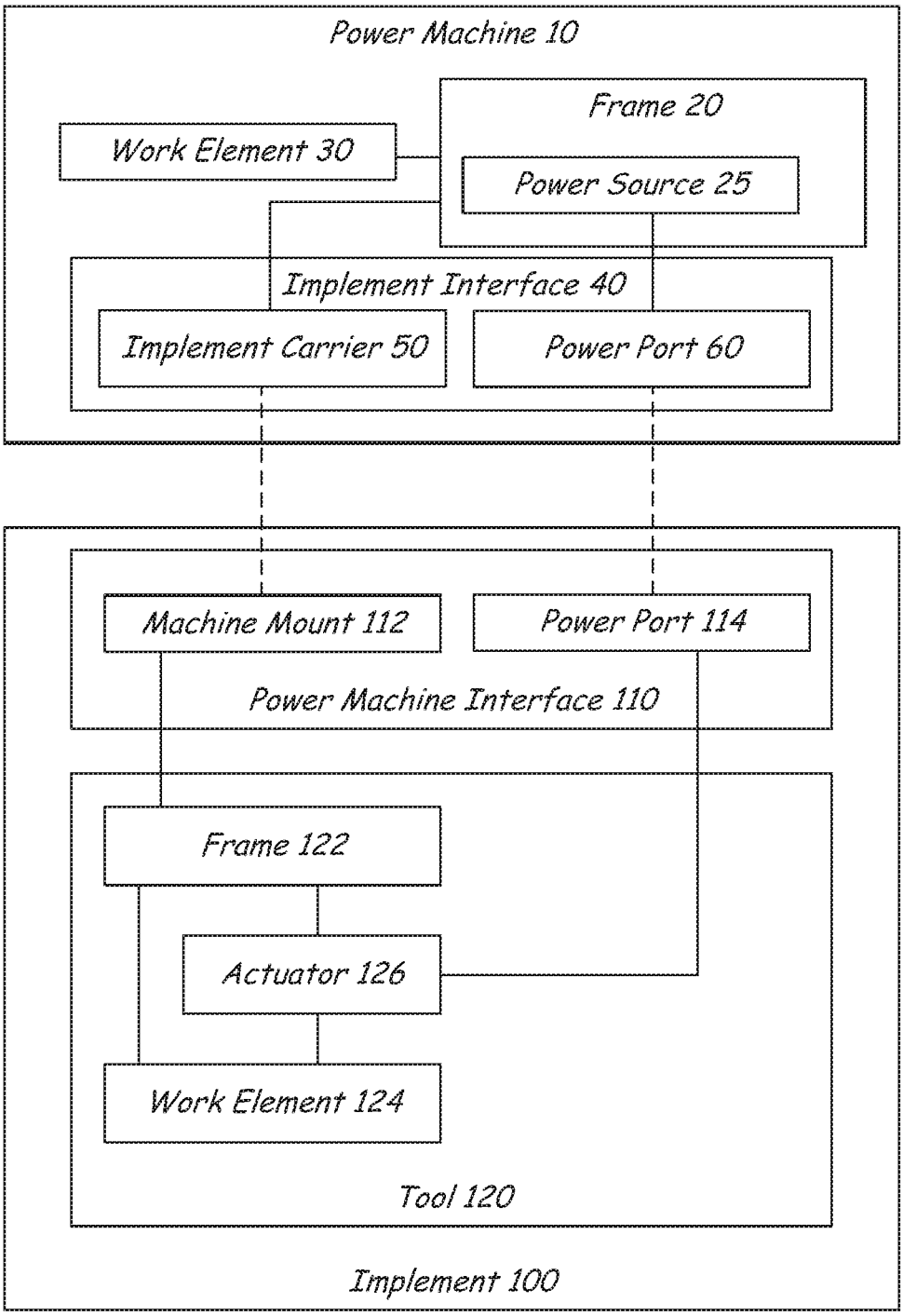
FIGS. 1-3 are each block diagrams illustrating functional systems of a representative implement on which embodiments of the present disclosure can be practiced and a power machine to which the representative implement can be coupled.

Referring now to FIG. 1, a block diagram illustrates basic systems of power machine 10 as are relevant to interact with implement 100 as well as basic features of implement 100, which represents an implement upon which the embodiments discussed below can be advantageously incorporated. At their most basic level, power machines for the purposes of this discussion include a frame 20, a power source 25, a work element 30, and, as shown in FIG. 1, an implement interface 40. On power machines such as loaders and excavators and other similar work vehicles, implement interface 40 includes an implement carrier 50 and a power port 60. The implement carrier 50 is typically rotatably attached to a lift arm or another work element and is capable of being secured to the implement. The power port 60 provides a connection for the implement 100 to provide power from the power source to the implement. Power source 25 represents one or more sources of power that are generated on power machine 10. This can include either or both of pressurized fluid and electrical power.

The implement 100, which is sometimes known as an attachment or an attachable implement, has a power machine interface 110 and a tool 120, which is coupled to the power machine interface 110. The power machine interface 110 illustratively includes a machine mount 112 and a power port 114 for coupling with power machine 10. Machine mount 112 can be any structure capable of being coupled to the implement interface 40 of power machine 10. Power port 114, in some embodiments, includes hydraulic and/or electrical couplers. Power port 114 can also include a wireless electrical connection, as may be applicable on a given implement. While both machine mount 112 and power port 114 are shown, some implements may have only one or the other as part of their power machine interface 110. Other implements, such as a bucket and some simple forklifts, would not have a power port 114 at all (e.g., See FIG. 3). Some other forklifts may have an actuator for adjusting its tines vertically, horizontally, rotationally, or by extending them in response to power signals received from the power machine 10 at power port 114.

In instances where a power machine has a specific implement carrier, the machine mount 112 will include a structure that complements the specific implement carrier. For power machines without an implement carrier, the machine mount includes features to directly mount the implement 100 to the power machine 10 such as bushings to accept pins for mounting the implement to a lift arm and an actuator for moving the implement.

For the purposes of this discussion, implements can be categorized as simple or complex. A simple implement has no actuated work element. One example of a simple implement is a bucket or a forklift without actuable tines. A complex implement has at least one actuable work element such as a forklift with actuable tines. Complex implements are further divided into those that have one actuable work element and those that have multiple work elements.

In FIG. 1, the implement 100 illustrates a tool 120 for a complex implement with a single work element 124. The tool 120 includes a frame 122, which is coupled with or integral to the machine mount 112. A work element 124 is coupled to the frame 122 and is moveable in some way (vertical, horizontal, rotation, extension, etc.) with respect to the frame. An actuator 126 is mounted to the frame 122 and the work element 124 and is actuable under power to move the work element with respect to the frame. Power is provided to the actuator 126 via the power machine. Power is selectively provided in the form of pressurized hydraulic fluid (or other power source) directly from the power machine 10 to the actuator 126 via power ports 60 and 114.

Figure 2:
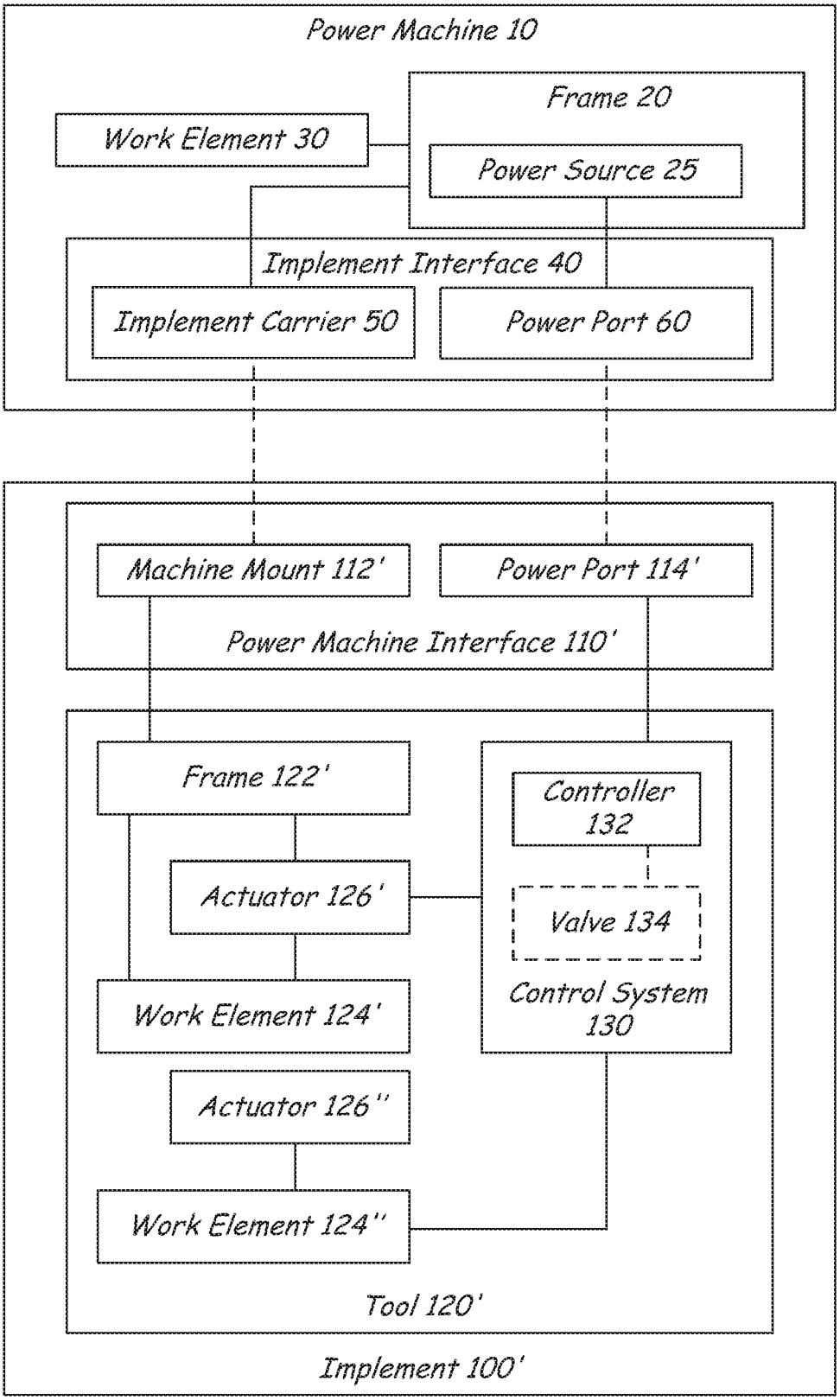

FIG. 2 illustrates an implement 100', which depicts a complex, multi-function implement. The features in FIG. 2 that are similarly numbered to those in FIG. 1 are substantially similar and are not discussed again here for the sake of brevity. Implement 100' has one or more additional work elements 124", which are shown in block form. Each work element 124" has a corresponding actuator 126" coupled thereto for controlling movement of the work element 124". A control system 130 receives power from the power machine and selectively provides power to the actuators 126' and 126" in response to signals from operator inputs. The control system 130 includes a controller 132, which is configured to receive electrical signals from the power machine 10 indicative of operator input manipulation and control power to the various actuators based on those electrical signals. The controller 132 can provide electrical signals to some or all of the actuators 126' and 126" to control their function. Alternatively, the controller 132 can control optional valve 134, which in turn controls actuation of some or all of the actuators 126' and 126" by providing pressurized hydraulic fluid to the actuators.

Although not shown in FIG. 2, in some instances, controller 132 can receive signals indicative of operator actuation of user inputs that are mounted on the implement, as opposed to the power machine. In these applications, the implement is controlled from an operator position that is located remotely from the power machine (i.e. next to the implement 100').

Figure 3:
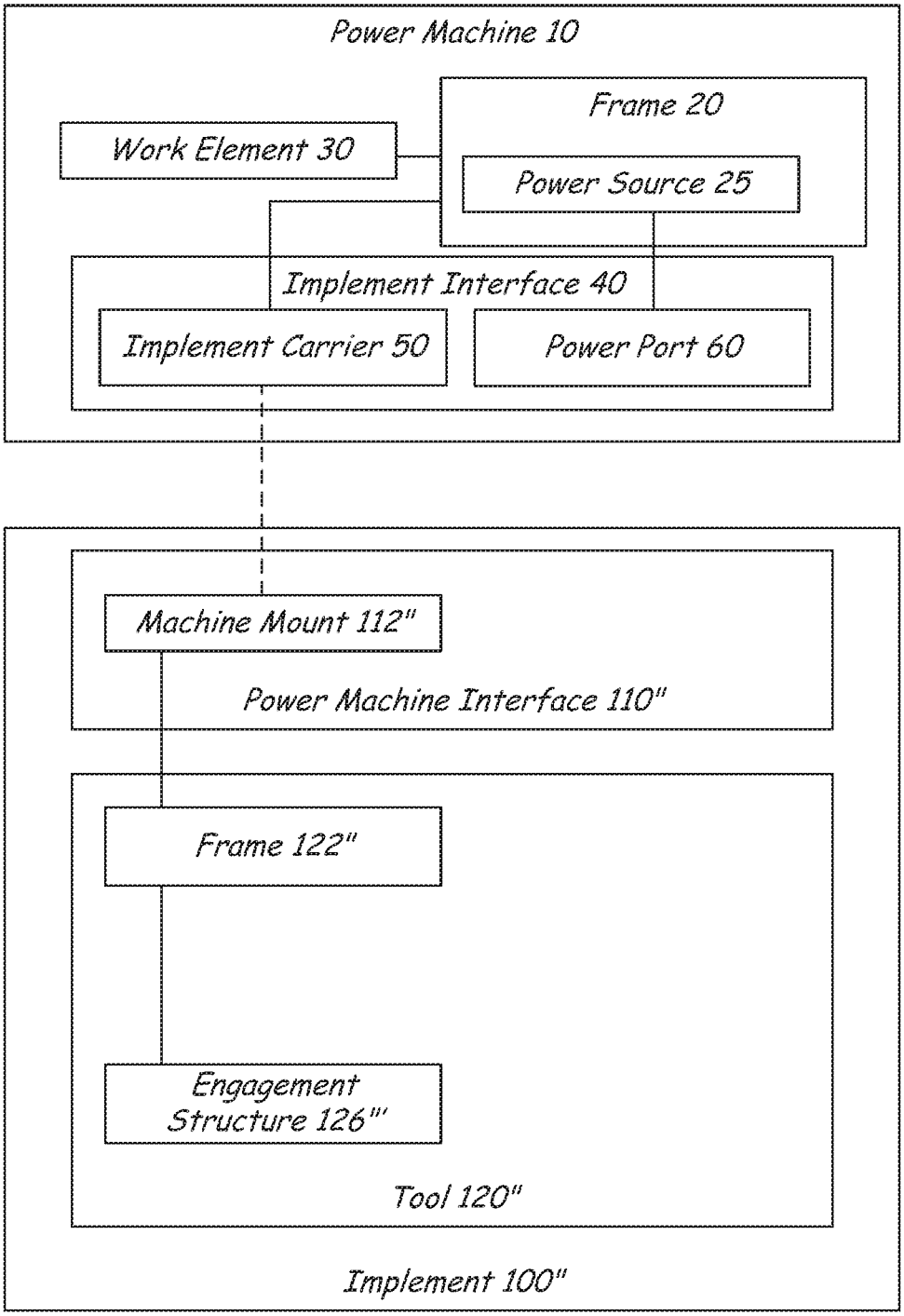

FIG. 3 illustrates an implement 100", which depicts a simple implement. The features in FIG. 3 that are similarly numbered to those in FIG. 1 are substantially similar and are not discussed again here for the sake of brevity. Implement 100" has one or more engagement structures 126" that is fixedly or moveably attached to the frame 122". Unlike a work element, which is powered by an actuator to move relative to the frame to perform a work function, the engagement structure can engage a medium to perform, in combination with the power machine, work. For example, a simple bucket has an engagement structure including a cutting edge and a defined volume that holds soil or material that is collected into a bucket. As another example, tines of a forklift can be mounted to the frame of the forklift implement for engaging a pallet. Such tines can be adjustable, but in many cases, the tines themselves are not moveable under power to perform work, but are instead engagement structures for engaging and supporting a load to be lifted and/or carried.

A power machine interface can include a machine mount in the form of a generally planar interface plate that is capable of being coupled to an implement carrier on a loader. In embodiments, various types of machine mounts can be employed. The power machine interface can also include a power port (e.g., see interfaces 110 and 110' of FIGS. 1 and 2 respectively), or not such as with the power machine interface 110" of FIG. 3. When the power machine interface includes a power port, the power port can include hydraulic conduits that are connectable to conduits on a power machine so that pressurized hydraulic fluid can be selectively provided to an actuator on the implement to actuate a connected working element. The power port can also include an electrical connection, which can be connectable to a controller (such as controller 132 of FIG. 2) and actuators on a valve (such as valve 134). The controller and valve can be included in a control system (such as control system 130) on the implement for controlling functions thereon.

Figure 4:
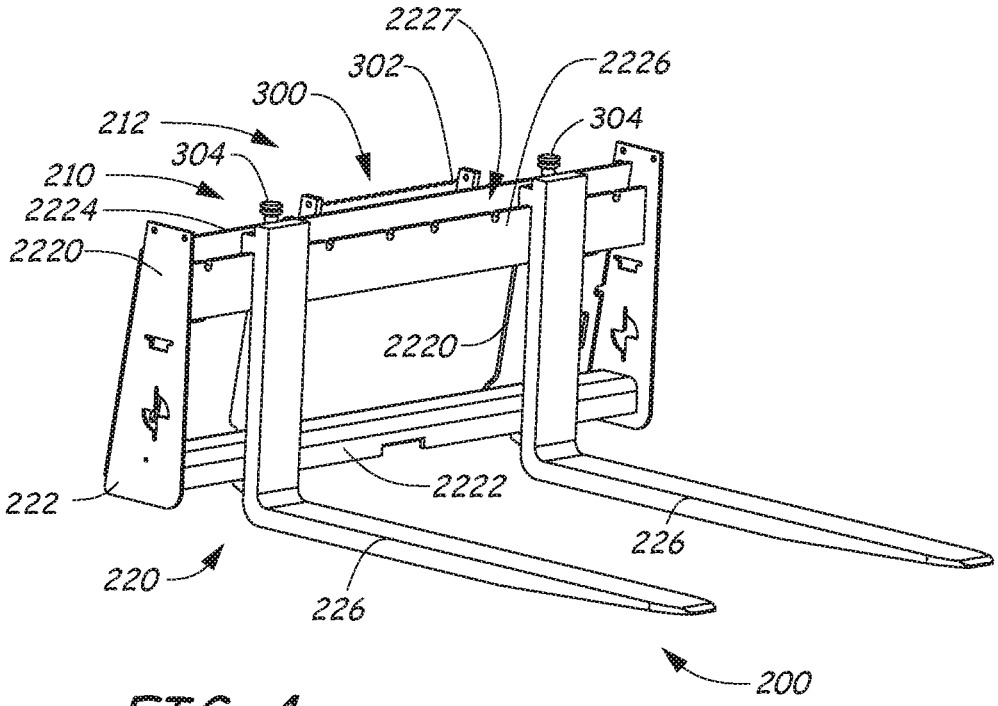
FIG. 4 illustrates a perspective view of an implement, such as the implement illustrated in FIG. 3 to which a modular backscreen can be attached according to one illustrative embodiment.

FIG. 4 illustrates a forklift implement 200 upon which modular backscreens can be mounted according to one illustrative embodiment. The implement 200 includes a tool 220 having a frame 222 and a pair of tines 226 that are carried on the frame, and a power machine interface 210 on an opposite side of the frame 222 from the tines. The power machine interface 210 includes a machine mount, referred to generally as 212, although not explicitly shown in FIG. 4. The machine mount 212 has features for engaging an implement carrier on a power machine. The implement 200 is shown attached to a power machine 600 in FIG. 6.

The frame 222 of tool 220 includes opposing side base parts 2220 and horizontal members 2222, 2224, and 2226 that extend between and are coupled to the opposing side base parts 2220. The horizontal member 2226 includes a plurality of notches 2227 for engaging the tines 226. The plurality of notches 2227 provides a number of locations for the tines 226 so that the tines can be set at various distances apart.

Referring to FIGS. 4-5 and 7-8, a first example embodiment of the modular backscreen 300 includes modular backscreen interface 302, inner vertical connectors 304, complementary connectors 306, fasteners 308, outer vertical connectors 310, and modular guard members 312. The modular backscreen interface 302 can be fixedly or removably attached to the horizontal member 2224. The modular backscreen interface 302 can also be fixedly or removably attached to the inner vertical connectors 304. The individual components of the backscreen are fastened to the implement so that any one of the components can be removed from the implement, allowing for various configurations for the backscreen.

The inner vertical connectors 304 can also be removably attached to a corresponding part of a guard 312 and a complementary connector 306, such that the guard is fastened to the frame 222 by the connectors 304 and 306 and the interface 302. It should be noted that removable attachments of the first example embodiment of the modular backscreen 300 can be fastened by fastener 308.

Figure 5:
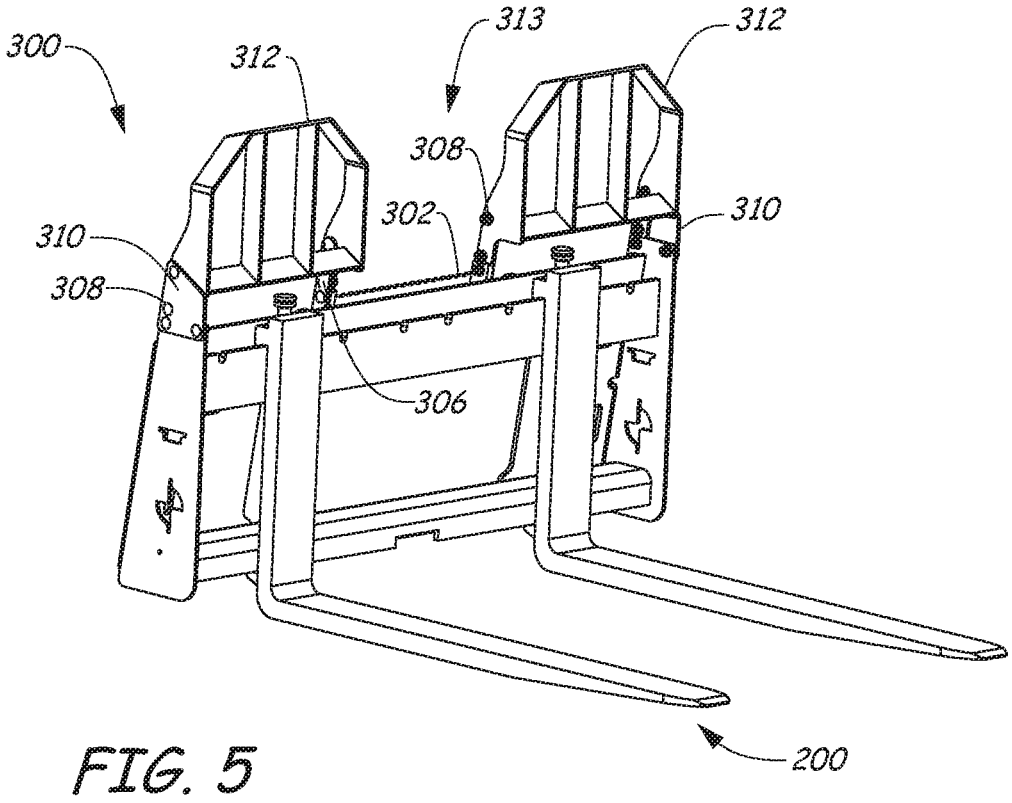
FIG. 5 illustrates a perspective view of the implement of FIG. 4 configured with portions of a modular backscreen system attached thereto.
Figure 7:
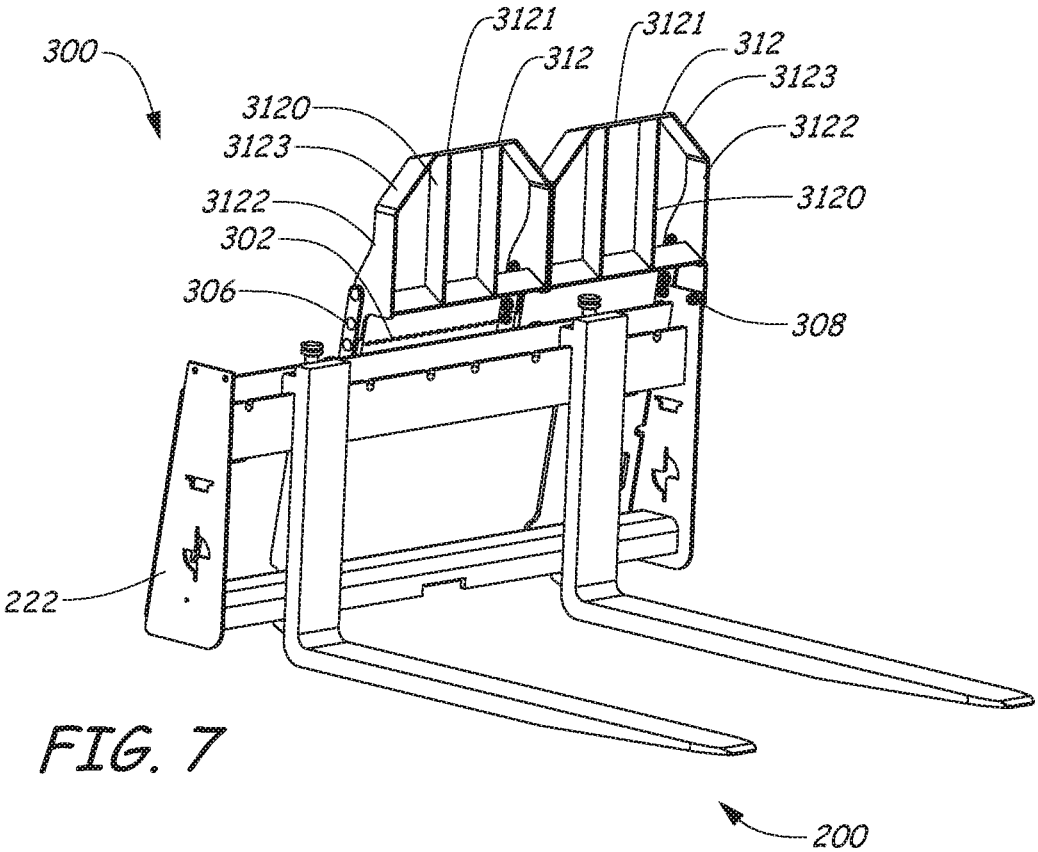
FIGS. 7 and 8 illustrate additional configurations of a modular backscreen on the implement of FIG. 4.
Figure 8:
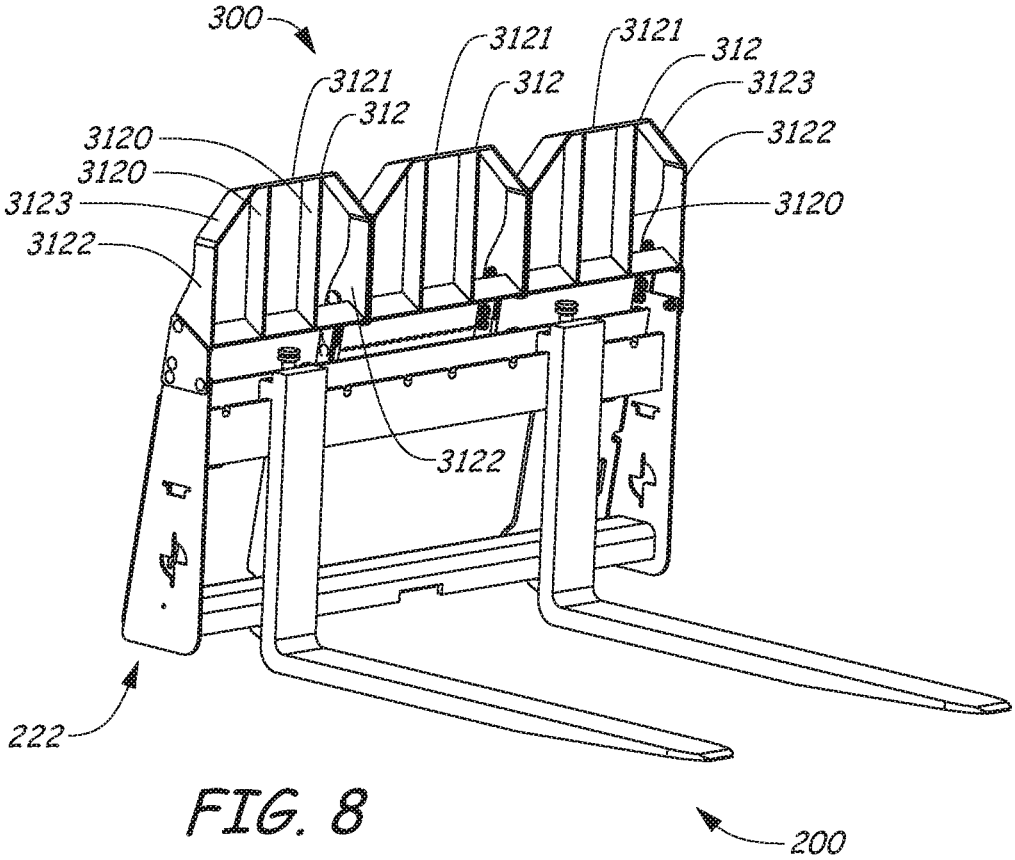

The outer vertical connectors 310 can be removably attached to the opposing side base parts 2220 and corresponding parts of respective instances of guard 312, such that guards are fastened to the frame 222 by the outer vertical connectors as well. FIGS. 5, 6, and 8 show the use of the outer vertical connectors 310 to removably attach two opposing guards 312 on each side of the frame 222. FIG. 7 shows the use of one of the outer vertical connectors 310 to removably attach one of the guards 312 on an outer portion on the top of the frame 222. Also, shown in FIG. 7, both of the two inner vertical connectors 304, the two complementary connectors 306, and the one outer vertical connector 310 are used to removably attach two adjacent guards on a side section and a middle section of the frame 222.

As depicted, the guards 312 include multiple vertical members or pillars 3120 supporting the top member or structure 3121 of each guard and side portions 3122. Angled members or portions 3123 connect the top structure 3121 and side portions 3122. The side portions 3122, on their lower regions, include complementary coupling elements for the inner vertical connectors 304, the complementary connectors 306, the fasteners 308, and the outer vertical connectors 310. The lower regions of the side portions 3122 are shown having feet that partially extend outwardly from guard 312 and toward a back side of the frame 222.

In addition to the first example embodiment of the modular backscreen 300, FIG. 6 also illustrates a perspective view of power machine 500 and the implement 200, showing the arrangement of the guards 312 such that there is a space 313 between the guards. The space 313 provides a path for an operator of a power machine to enter and exit a cab of the power machine.

Figure 9:
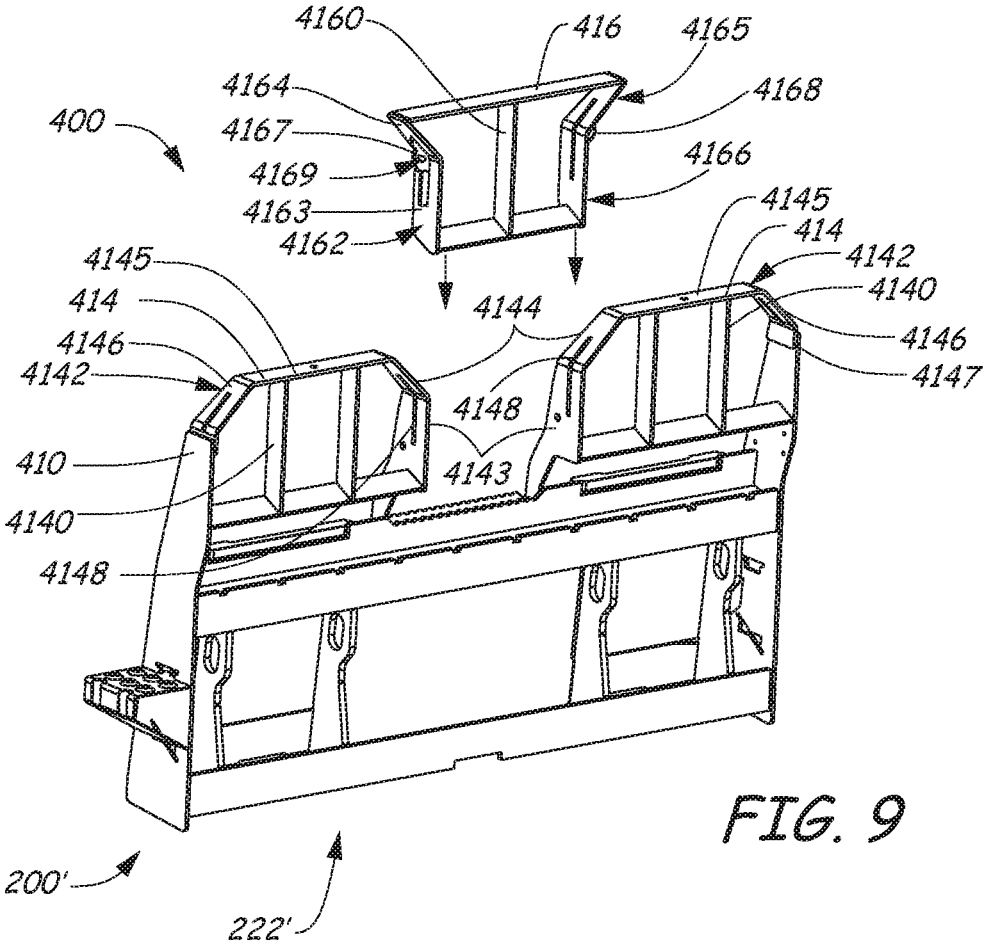
FIG. 9 illustrates a perspective view of a portion of a frame of an implement along with a pair of sections of an exemplary embodiment of the modular backscreen previously mounted thereto and an additional section of a modular backscreen in position to be attached to the previously mounted sections of the modular backscreen.
Figure 10:
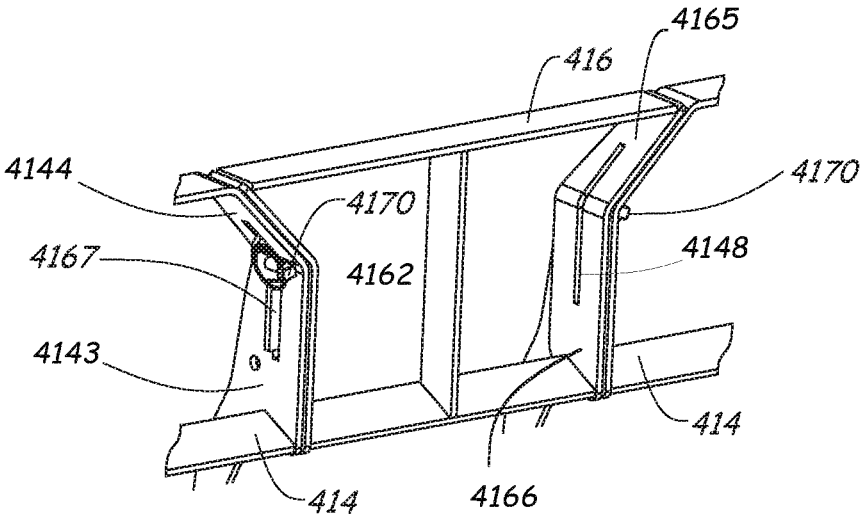
FIG. 10 illustrates another partial perspective view of the implement of FIG. 9 with the additional section of the modular backscreen attached to the previously mounted sections.
Figure 11:
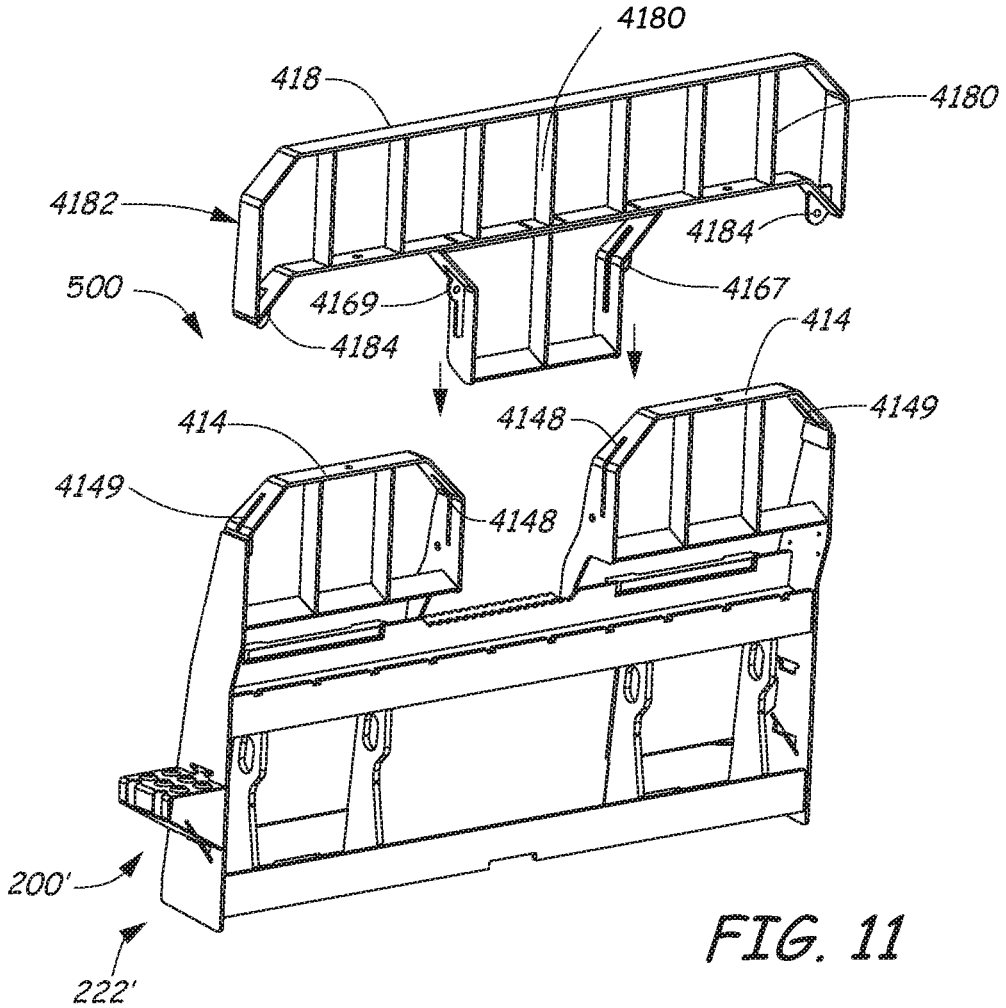
FIG. 11 illustrates a partial perspective view of the implement of FIG. 9 along with another example of an additional section of a modular backscreen in position to be attached to the previously mounted sections of the modular backscreen.

Referring to FIGS. 9-12, further example embodiments of the modular backscreen are shown in modular backscreens 400 and 500. In FIGS. 9 and 11, a portion of an implement 200' shows a frame 222' to which tines can be attached. Modular backscreens 400 and 500 include various features that are similar to modular backscreen 300, and similar features (not discussed below for the sake of brevity) are numbered similarly in FIGS. 9-12. Modular backscreens 400 and 500 includes a pair of guards 414 that are fixed to the frame 222 such as by welding. In FIG. 9, an additional guard 416 is shown above the guards 414. In FIG. 11, an additional guard 418 is shown above the guards 414. The guards 416 and 418 are configured to be attached to each of the guards 414 as shown in, and discussed with reference to, FIGS. 10 and 12.

As depicted, the guards 414 each include multiple vertical pillars 4140 supporting a perimeter structure 4142 of each guard 414. The pillars 4140 not only support the perimeter 4142, but they also provide a support for any material that may be loaded on the implement. In other embodiments, pillars can be horizontal or diagonal, or some combination of vertical, horizontal, and/or diagonal. The perimeter structure 4142 of each of the guards 414 as shown in FIG. 9 are mirror images of each other and the description of this perimeter structure is applicable to each guard 414. The perimeter structure 4142 defines an edge of each of the guards and provides interface features for other guard members, thereby allowing the connection of multiple guards to form a modular backscreen. As shown, the perimeter 4142 includes a first portion 4143, which extends vertically on an inside (i.e. toward the center of the implement) of the guard, a second, angled portion 4144 between the first portion and a third, horizontal top portion 4145. A fourth, angled portion 4146 connects the third portion with a fifth, vertical outside portion 4147. A slot 4148 extends through the first and second portions for receiving a feature (described below) for securing another guard to guard 414. Likewise, the fourth, angled portion 4146 also includes a slot 4149 for receiving another feature to secure another guard to guard 414. In other embodiments, interface features other than slots 4148 and 4149 can be included on the perimeter 4142.

As shown, the guard 416 includes a vertical pillar 4160 supporting a perimeter structure 4162 of the guard as well as providing a support for material that is loaded on the implement. The perimeter structure 4162 has complementary surfaces 4163-4166 for fitting against portions of the perimeter as well as other portions (i.e. top and bottom surfaces) that complete the perimeter. Engagement features 4167 and 4168 are mounted on opposing sides of the guard 416. The illustrative engagement features 4167 and 4168 each are tabs that are configured to engage with slots 4148 as is shown in FIG. 10. A locking mechanism such as a linchpin 4170 or other suitable attachment mechanism can be inserted into an aperture 4169 of each of the engagement features 4167 and 4168 to secure the guard 416 to guards 414. In alternative embodiments (not shown), guard 416 can have engagement features to allow it to be secured to the frame 222' of implement 200' as well.

Figure 12:
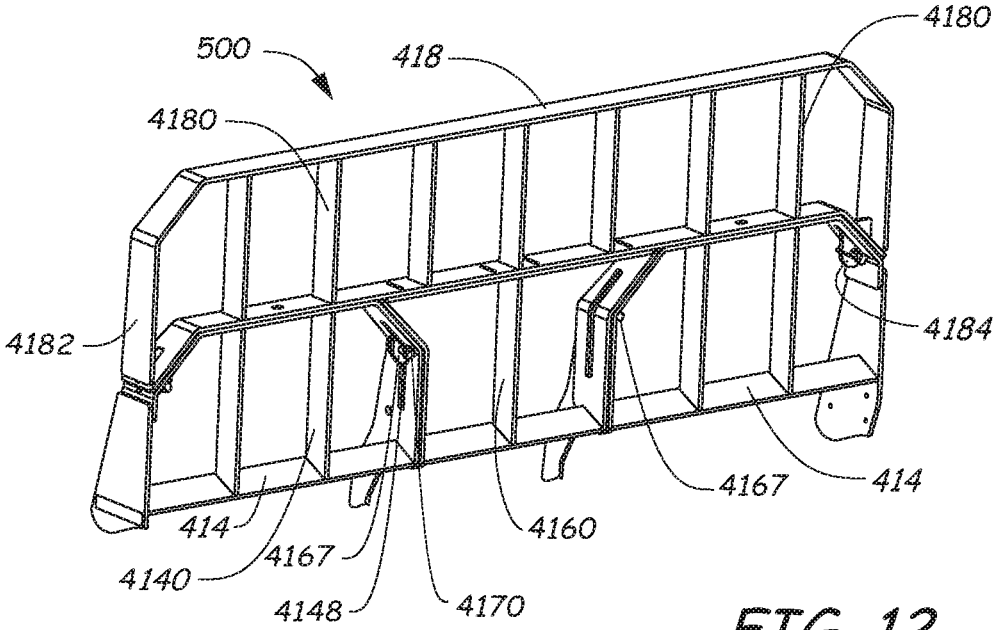
FIG. 12 illustrates a partial perspective view of the implement of FIG. 11 with the additional section of the modular backscreen attached to the previously mounted sections.

FIGS. 11-12 illustrate modular backscreen 500 having a guard 418 mounted between and on top of two of guards 414. As illustrated, the guard 418 includes multiple vertical pillars 4180 supporting a perimeter 4182 of the guard. The perimeter 4180 has complementary surfaces to engage the perimeters 4142 of the guards 414, similar to the manner in which the guard 416 engaged with guards 414. In some embodiments (not shown in FIGS. 11-12), guard 418 include other engagement features to engage with guards 414. Guard 418 includes engagement features 4169 and 4184 for engaging slots 4148 and 4149 on guards 414. In some embodiments, guard 418 can have slots or other engagement features (not shown) on a top surface for receiving an additional guard above guard 418 to allow further modular addition to the backscreen.

Although the present invention has been described with reference to preferred embodiments, workers skilled in the art will recognize that changes may be made in form and detail without departing from the spirit and scope of the invention.

What is claimed is:

1. A backscreen accessory for an implement of a power machine, the implement having a frame with a first side and a second side, the accessory comprising:

a first backscreen portion having a first end attached to the frame of the implement and a second end attached to the frame of the implement, the first backscreen portion having at least one first portion interface feature; and a second backscreen portion having at least one second portion interface feature, wherein the at least one first portion interface feature and the at least one second portion interface feature are configured to engage to removably couple the second backscreen portion to the first backscreen portion such that the second backscreen portion extends toward the second side of the frame in a direction away from both of the first and second ends of the first backscreen portion in a laterally offset position with respect to the first backscreen portion.

2. The backscreen accessory of claim 1, wherein the at least one first portion interface feature and the at least one second portion interface feature are configured to engage to removably couple the second backscreen portion to the first backscreen portion at a position adjacent a side of the first backscreen portion.

3. The backscreen accessory of claim 2, wherein the at least one second portion interface feature includes a first second portion interface feature, and wherein the at least one first portion interface feature and the first second portion interface feature are configured to engage to removably couple the second backscreen portion to the first backscreen portion, and further comprising a third backscreen portion configured to be attached to the frame of the implement, wherein the at least one first portion interface feature and the first second portion interface feature are configured to engage to removably couple the second backscreen portion to the first backscreen portion at a position between the first and third backscreen portions.

4. The backscreen accessory of claim 3, wherein the third backscreen portion includes at least one third portion interface feature, wherein the at least one second portion interface feature includes a second second portion interface feature, and wherein the second second portion interface feature and the at least one third portion interface feature are configured to engage to removably couple the second backscreen portion to the third backscreen portion.

5. The backscreen accessory of claim 2, wherein when the second backscreen portion is removably secured to the first backscreen portion, top surfaces of both of the first and second backscreen portions extend to substantially a same height relative to the implement.

6. The backscreen assembly of claim 2, wherein the at least one first portion interface feature and the at least one second portion interface feature are configured to engage to removably couple the second backscreen portion to the first backscreen portion at a position which is both adjacent the side of the first backscreen portion and above the first backscreen portion.

7. The backscreen assembly of claim 1, wherein the first backscreen portion is welded to the frame of the implement.

8. The backscreen assembly of claim 1, wherein one of the at least one first portion interface feature and the at least one second portion interface feature includes a slot, and the other of the at least one first portion interface feature and the at least one second portion interface feature includes a tab configured to be received in the slot.

9. The backscreen assembly of claim 1, wherein the first and second backscreen portions include a plurality of vertically oriented members.

10. The backscreen assembly of claim 1, wherein the first and second backscreen portions include screens.

11. The backscreen accessory of claim 1, wherein when the at least one first portion interface feature and the at least one second portion interface feature are engaged to removably couple the second backscreen portion to the first backscreen portion, the first backscreen portion extends toward the first side of the frame in a direction away from both of the second backscreen portion and the second end of the first backscreen portion.

12. An implement comprising:

an implement interface configured to removably mount the implement to a power machine interface;

a tool having a frame secured to the implement interface, the frame having a first side and a second side; and a modular backscreen attached to one of the implement interface and the tool, the modular backscreen comprising:

a first backscreen portion having a first end attached to the one of the implement interface and the tool and having a second end attached to the one of the implement interface and the tool, the first backscreen portion including a first portion interface feature; and a second backscreen portion having a first second portion interface feature, wherein the first portion interface feature and the first second portion interface feature are configured to engage to removably couple the second backscreen portion to the first backscreen portion such that the second backscreen portion extends in a first direction toward the second side of the frame and away from both of the first and second ends of the first backscreen portion in a laterally offset position with respect to the first backscreen portion.

13. The implement of claim 12, and further comprising a third backscreen portion attached to the one of the implement interface and the tool, the third backscreen portion including a third portion interface feature, wherein a second second portion interface feature of the second backscreen portion and the third portion interface feature are configured to engage to removably couple the second backscreen portion also to the third backscreen portion at a position at least partially between the first and third backscreen portions.

14. The implement of claim 13, wherein when the second backscreen portion is removably secured to the first and third backscreen portions, top surfaces of all of the first, second and third backscreen portions extend to substantially a same height relative to the one of the implement interface and the tool.

15. The implement of claim 13, wherein when the second backscreen portion is removably secured to the first and third backscreen portions, the second backscreen portion is positioned both between and above the first and third backscreen portions.

16. The implement of claim 13, wherein the first and third backscreen portions are welded to the one of the implement interface and the tool.

17. The implement of claim 13, wherein first portion interface feature, the first and second second portion interface features, and the third portion interface feature collectively comprise at least two slots and at least two corresponding tabs configured to be received in the slots.

18. The implement of claim 13, wherein the first, second and third backscreen portions include a plurality of vertically oriented members.

19. The implement of claim 13, wherein at least one of the first, second and third backscreen portions include a screen or grid of vertically oriented members and horizontally oriented members.

* * * * *